United States Patent [19]

Takamatsu et al.

[11] 4,352,640

[45] Oct. 5, 1982

[54] FLUID COMPRESSOR

[75] Inventors: Hiroshi Takamatsu, Ohi; Hiroshi Tanaka, Niiza; Mutuo Sugisaki, Ohi, all of Japan

[73] Assignee: Honda Giken Kogyo Kabushiki Kaisha, Tokyo, Japan

[21] Appl. No.: 123,453

[22] Filed: Feb. 21, 1980

[30] Foreign Application Priority Data

Feb. 24, 1979 [JP] Japan ..... 54-022427[U]

[51] Int. Cl.[3] ..... F04B 1/04

[52] U.S. Cl. ..... 417/273

[58] Field of Search ..... 417/273; 92/58; 91/491, 91/492

[56] References Cited

U.S. PATENT DOCUMENTS

| | | | |
|---|---|---|---|
| B 416,933 | 1/1975 | Gaines et al. | 417/273 X |
| 3,685,923 | 8/1972 | Hutchins et al. | 417/273 |
| 3,784,331 | 1/1974 | Heidorn | 417/273 |
| 3,800,675 | 4/1974 | Jacobs | 417/273 X |
| 3,871,793 | 3/1975 | Olson | 417/273 |
| 4,050,852 | 9/1977 | Brucken et al. | 417/273 |

FOREIGN PATENT DOCUMENTS 53-63771 12/1979 Japan .

*Primary Examiner*—Carlton R. Croyle
*Assistant Examiner*—Edward Look
*Attorney, Agent, or Firm*—Lyon & Lyon

[57] ABSTRACT

A fluid compressor in which the drive shaft is arranged in a casing including a fluid suction chamber and a fluid discharge chamber concentrically formed therein, with an eccentric end thereof projected from an open end of the casing. Secured to the open end of the casing is a cylinder housing formed integrally with cylinders cruciformly intersecting with each other. Placed in the cylinders are pistons which define therein a recess in which the eccentric end of the drive shaft is fitted. A flange-like bearing retainer chamber is secured to the inner peripheral wall of the open end of the casing which has a hub bulged in the cylinder housing. A needle bearing is mounted in the hub with a portion thereof located in the cylinder housing and supports a portion of the drive shaft adjacent the eccentric end thereof.

8 Claims, 5 Drawing Figures

FLUID COMPRESSOR

BACKGROUND OF THE INVENTION

This invention relates to a fluid compressor, and more particularly to a radial type fluid compressor adapted for use in air conditioning of motor vehicles.

In general, it is desirable that compressors for use in an air conditioner for motor vehicles should be designed compactly in size and should have a high compression efficiency at the same time to permit installation thereof in a limited engine space.

In order to comply with such requirements, a fluid compressor has conventionally been proposed which comprises: a cylinder casing formed therein with vertical and horizontal cylinder bores intersecting with each other in a common plane; two pairs of pistons, each pair being slidably fitted in each of the cylinder bores; an outer shell member fitted on the cylinder casing, the outer shell member and the cylinder casing forming a compressor housing; a drive shaft extending through the casing and the outer shell member, the drive shaft having an eccentric portion formed at a central portion thereof, the eccentric portion being located at the intersection of the cylinder bores; a pair of bearings provided at opposite ends of and near the eccentric portion of the drive shaft; a low pressure chamber formed around a portion of the drive shaft near an end thereof; and a high pressure chamber formed around and adjacent each of the cylinder bores.

With this arrangement, the proposed fluid compressor has a shortened longitudinal size or length and is capable of compressing refrigerant gas at a higher rate.

According to this proposed compressor, since the drive shaft has an eccentric portion located at a center thereof, the upper and lower and left and right pistons received in the vertical and horizontal cylinder bores have to be manufactured separately and coupled together in pairs by means of yoke members.

This compressor therefore requires many component parts and is complicated in structure, making it difficult to put together the same. Further, the above-mentioned arrangement does not permit smooth lubrication of the piston-mounted portions and the drive shaft bearing portions of the compressor, causing difficulties in the sliding motion of the pistons. Still further, since the cylinder bores are each enveloped in a high pressure refrigerant gas, the cylinder housing is difficult to cool and is accordingly apt to be overheated, resulting in a low gas compression efficiency. In addition, it is rather hard to mount the outer shell member onto the cylinder housing in a sealed manner.

To overcome the above-mentioned disadvantages, a compressor has been proposed according to Japanese Patent Application No. 53-63771, assigned to the same assignee of the present application, which comprises: a front part casing formed therein with a drive shaft bearing section and a refrigerant containing section having a refrigerant suction chamber and a refrigerant discharge chamber arranged concentrically with each other; and a cylinder housing secured to a rear end of the front part casing in an abutting manner, the cylinder housing being formed integrally with a vertical cylinder and a horizontal cylinder cruciformly intersecting with each other in a common plane on an outer end surface thereof. A drive shaft is supported in the front part casing in an overhung fashion. That is, it has a rear end thereof formed as an eccentric end which is projected in a central space defined in the cylinder housing. According to this compressor, a pair of double head type piston units are housed in a vertical cylinder and a horizontal cylinder in a fashion crossing each other, wherein these piston units are coupled to the eccentric end of the drive shaft through a box-like sliding member. Lubricating oil in the refrigerant can be introduced into the cylinder housing from the refrigerant suction chamber formed in the front part casing through a through bore formed in the drive shaft and a main bearing supporting the drive shaft. Thus, the compressor is simple in structure and is easy to assemble as well as high in refrigerant gas compression efficiency and lubrication efficiency, succeeding in overcoming the drawbacks in the first-mentioned compressor.

However, according to this compressor, the drive shaft is supported in the front part casing in an overhung fashion with its eccentric end projected in the cylinder housing as mentioned above. Therefore, if the overhung distance, i.e., the distance between the axis of the piston units and the axial center of the main bearing supporting the drive shaft at a portion near the eccentric end thereof is large, the main bearing can be subject to a considerably large force during operation of the compressor, which results not only in reduction in the life of the main bearing but also in shaking or vibration of the drive shaft. Therefore, the above-mentioned distance should preferably be as small as possible.

In this respect, according to the above-stated proposed compressor assigned to the present assignee, a ball bearing is directly mounted on the inner wall of the front part casing as the main bearing. Accordingly, the ball bearing must have a large size, and in actual manufacture, the leftmost position at which it can be located is just a portion near the junction wall between the cylinder housing and the front part casing. That is, the bearing cannot be located at a position closer to the piston units in a fashion lying over the junction wall. Thus, the distance between the main bearing and the eccentric end of the drive shaft or the piston units is inevitably rather large.

OBJECTS AND SUMMARY OF THE INVENTION

The present invention has been made in order to eliminate the above-mentioned disadvantages, and its primary object is to provide a radial type fluid compressor which is designed such that the bearing portion supporting the drive shaft is subject to smaller loads to thereby prevent shaking or vibration of the drive shaft and assure a long life of the bearing.

A further object of the invention is to provide a radial type fluid compressor which is simple in structure and compact in size as well as easy to assemble.

Another object of the invention is to provide a radial type fluid compressor which is constructed to permit sufficient lubrication of the piston-mounted portions and the drive shaft bearing portions.

Still another object of the invention is to provide a radial type fluid compressor which is constructed to permit permanent cooling of the cylinder-piston assembly section to obtain an improved fluid compression efficiency.

According to the invention, a drive shaft having one end thereof eccentric with respect to the axis thereof is rotatably supported in a casing including a fluid suction chamber and a fluid discharge chamber concentrically formed therein in a fashion that the eccentric end of the drive shaft is projected from an open end of the casing. A flange-shaped bearing retainer member is secured at a peripheral edge thereof to the inner peripheral surface of the open end of the casing. The retainer member has a hub formed centrally thereof and is disposed around a portion of the drive shaft adjacent the eccentric end thereof with the adjacent portion of the drive shaft fitted in a central through bore formed in the hub thereof. The hub of the retainer member is bulged in the interior of a cylinder housing which is secured to the open end of the casing and is formed integrally with cylinders cruciformly intersecting with each other in a common plane and bulged to the outside, the cylinders housing double head type pistons. A needle bearing is mounted in the central through bore of the hub and serves as a main bearing to support the aforementioned portion of the drive shaft adjacent the eccentric end thereof. The needle bearing has a portion thereof located in a spatial portion defined at the intersection of the cylinders in the cylinder housing. The bearing retainer member is provided with a fluid passage communicating the fluid suction chamber with the interior of the cylinder housing as well as a bore communicating the fluid suction chamber with the central through bore in the hub for supplying lubricating oil mixed in the refrigerant to the main needle bearing mounted in the central through bore.

These and other objects, features and advantages of the invention will be more apparent upon a reading of the ensuing detailed description and the drawings.

BRIEF DESCRIPTION OF THE DRAWINGS

The accompanying drawings illustrate a fluid compressor according to one embodiment of the invention, in which.

DETAILED DESCRIPTION

Figure 1:
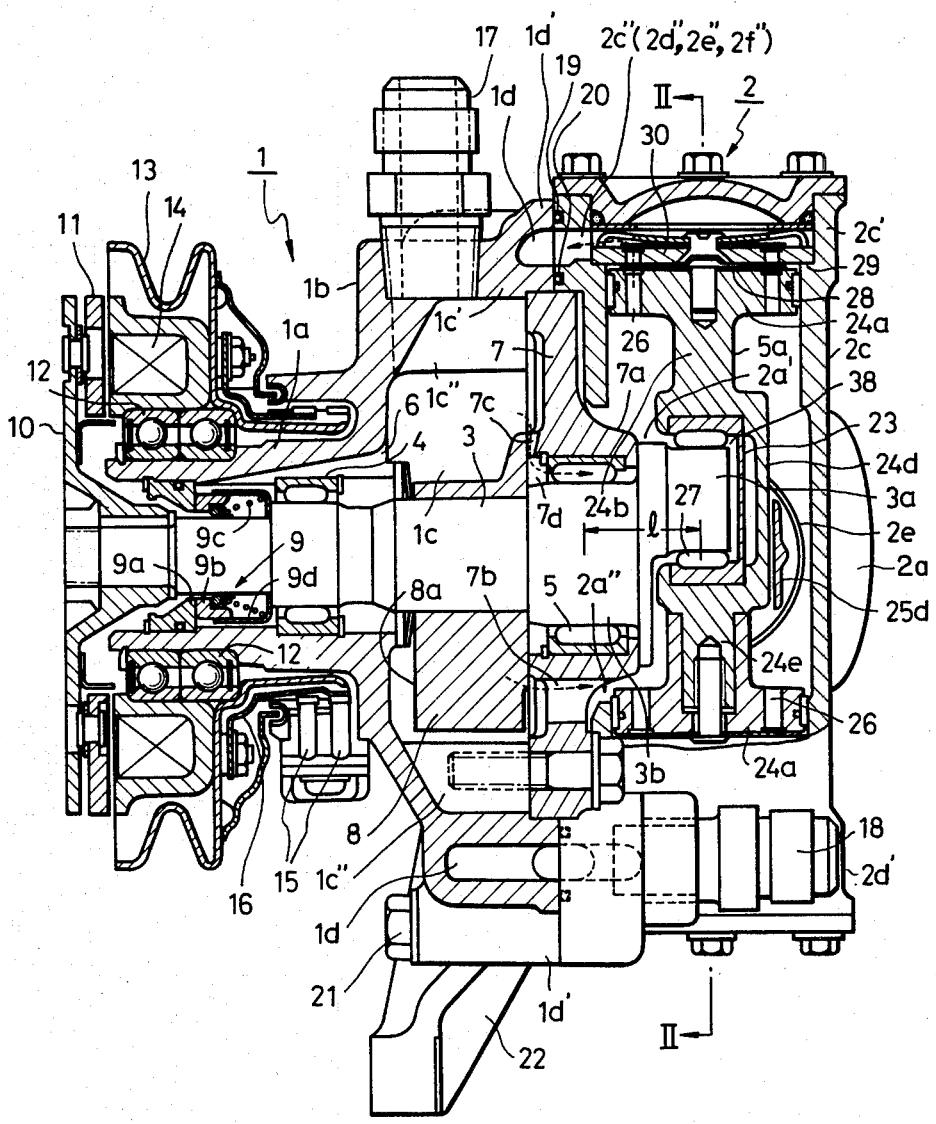
FIG. 1 is a longitudinal vertical sectional view of the fluid compressor.
Figure 2:
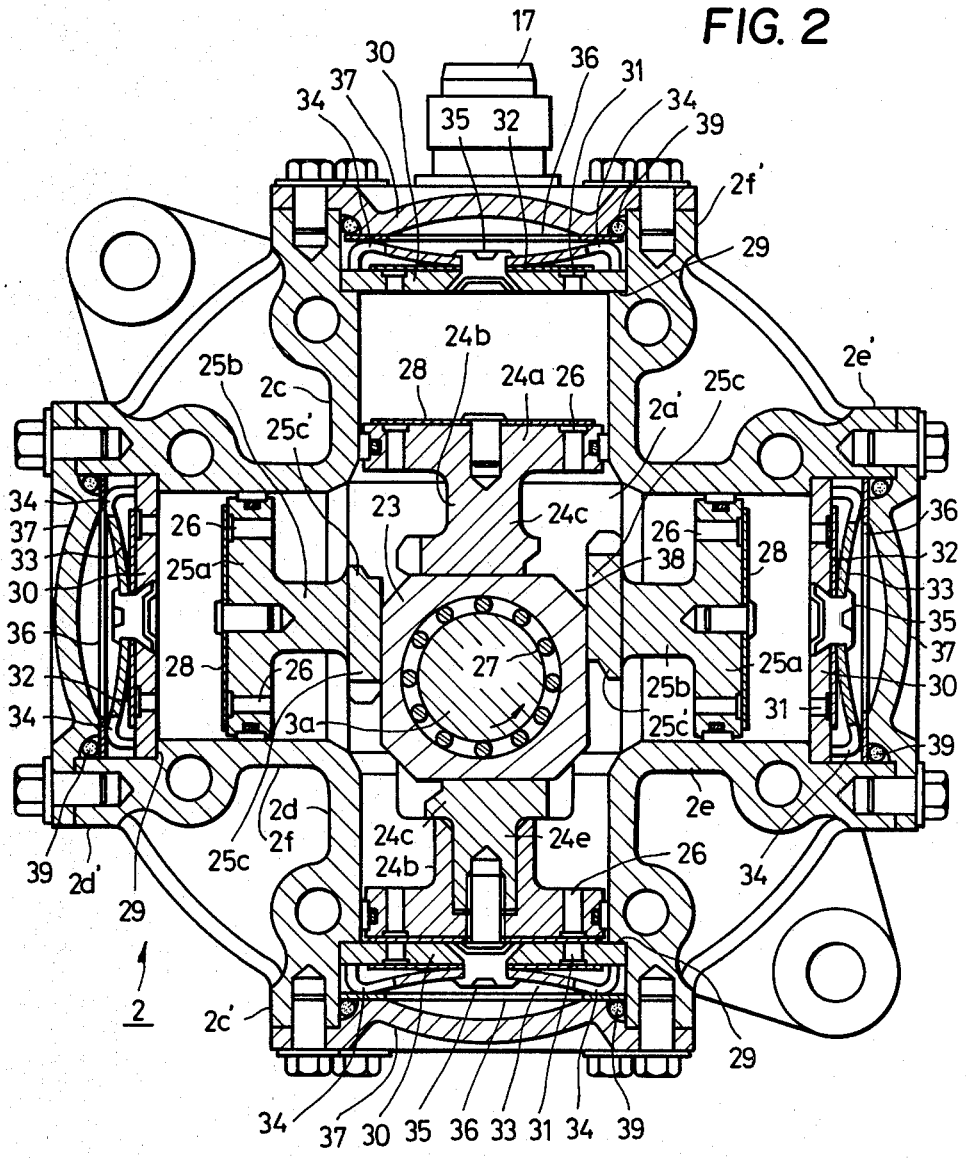
FIG. 2 is a transverse sectional view taken on line II—II in FIG. 1.

A preferred embodiment of the invention will be described with reference to the accompanying drawings. Referring first to FIGS. 1 and 2, reference numeral 1 designates a compressor casing which presents a cylindrical configuration. The front half portion (the left half portion in FIG. 1) of the casing 1 contains a drive shaft driving section 1*a*, and the rear half portion (the right half portion in FIG. 1) is expanded and defines therein a refrigerant gas containing section 1*b*. The refrigerant gas containing section 1*b* has its rear end configurated open and includes a low pressure gas suction chamber 1*c* located radially inwardly thereof and a high pressure gas discharge chamber 1*d* formed around the rear half portion of the inner chamber 1*c* in concentricity therewith.

A cylinder housing 2 is mounted on the open rear end of the refrigerant gas containing section 1*b* in an abutting fashion, in which is arranged a cylinder-piston assembly hereinlater described. Due to the above-mentioned concentric arrangement of the suction chamber 1*c* and the discharge chamber 1*d*, the cylinder housing 2 can be designed small in outside diameter, making compact the whole compressor.

A drive shaft 3 extends through the interior of the casing 1, which has its rear end 3*a* formed eccentrically with respect to its axis. The drive shaft 3 is rotatably supported in an overhung fashion by an auxiliary bearing 4 provided in the shaft driving section 1*a* and the main bearing 5 provided in the refrigerant gas containing section 1*b*, with its eccentric end 3*a* projected rearwardly of the open rear end of the refrigerant gas containing section 1*b*.

Fitted in the rear end portion of the suction chamber 1*c* is a flange-like bearing retainer member 7 which has a hub 7*a* formed centrally thereof and bulged rearwardly. This retainer member 7 has its peripheral edge secured by screws to ribs 1*c*″ provided at circumferentially predetermined intervals in the inner peripheral surface of the refrigerant suction chamber 1*c* with its hub 7*a* overhung in a central space 2*a*′ defined in the cylinder housing 2. The aforementioned main bearing 5 which comprises a needle bearing is mounted in a through bore 7*d* centrally formed in the hub 7*a* in a fashion that its rearward half portion is located in the above-mentioned central space 2*a*′, to support the neck portion 3*b* of the drive shaft 3 adjacent the eccentric end 3*a*. Thus, the main bearing 5 is located very close to the mounting position of piston units hereinlater described so that the distance l between the axial center of the main bearing and the axis of the piston units is reduced. Consequently, the longitudinal size or length of the compressor can be shortened, the main bearing 5 can be subject to smaller loads, and the drive shaft 3 can be free of shaking or vibration even after a long period of use, thus to obtain an increased effective life of the main bearing. Further, the neck portion 3*b* of the drive shaft 3 can be designed smaller in thickness than a conventional one.

The bearing retainer member 7 has a through bore 7*b* formed therein which communicates the refrigerant suction chamber 1*c* with the interior of the cylinder housing 2 as well as a radial bore 7*c* which communicates the chamber 1*c* with the bearing housing space 7*d* formed through the retainer member 7, thus permitting refrigerant mixed with lubricating oil to be supplied from the suction chamber 1*c* into the cylinder housing 2 directly or via the needle bearing 5.

Part of the inner peripheral wall of the shaft driving section 1*a* in which the needle bearing 4 is mounted is formed therein with a channel 6 communicating with the refrigerant suction chamber 1*c* to permit misty lubricating oil contained in the refrigerant gas to be guided to the needle bearing 4.

The drive shaft 3 carries a balance weight 8 force fitted on a portion thereof located in the refrigerant suction chamber 1*c* which maintains the balance of the rotation of the drive shaft 3 with the inertia force of the piston units, etc. in the cylinder housing 2. This balance weight 8 has its rear end face disposed in urging contact with the front end face of the hub 7*a* of the bearing retainer member 7 to prevent axial movement of the shaft 3.

A shaft sealing assembly 9 is provided on a portion of the drive shaft 3 lying ahead of the needle bearing 4 which comprises a sealing ring 9*a*, a rotary sealing piece 9*b*, a compression spring 9*c* and a bracket 9*d*. A retainer disc 10 is wedged to the front end of the drive shaft 3, at the outer periphery of which is arranged a clutch plate 11 which also serves as a balance weight and is joined to the disc 10 by means of a plurality of links, not shown.

The aforementioned clutch plate 11 is disposed opposite an electromagnet 14 embedded in a pulley 13 which is rotatably supported on the shaft driving section 1*a* of the casing 1 by means of ball bearings 12. The electromagnet 14 is arranged to be energized by way of brushes 15 and a leading-in plate 16 provided in the same shaft driving section 1*a*.

A refrigerant inlet port 17 is mounted in a central portion of the casing 1 in communication with the low pressure gas suction chamber 1*c*, which port can be connected to the evaporator, not shown, of an associated cooling system. A refrigerant outlet pipe 18 is fitted in the high pressure gas discharge chamber 1*d* formed around the outer periphery of the rear portion of the suction chamber 1*c*, which can be connected to the condenser, not shown, of the cooling system. The rear ends of the low pressure gas suction chamber 1*c* and the high pressure gas discharge chamber 1*d* forming the refrigerant gas containing section 1*b* are open, as previously mentioned, and the peripheral walls 1*c*' and 1*d*' surrounding these chambers have their rear end faces terminating in a common vertical plane. Annular sealing members 19 and 20 are interposed between these rear peripheral walls and the associated peripheral walls of the cylinder housing 2.

The peripheral wall 1*d*' of the high pressure discharge chamber 1*d* has several thickened portions formed at circumferentially predetermined intervals in which coupling bolts 21 are inserted. Provided on the outer surfaces of these thickened portions are fitting legs 22 adapted to be fixed in an engine space in a motor vehicle.

Figure 3:
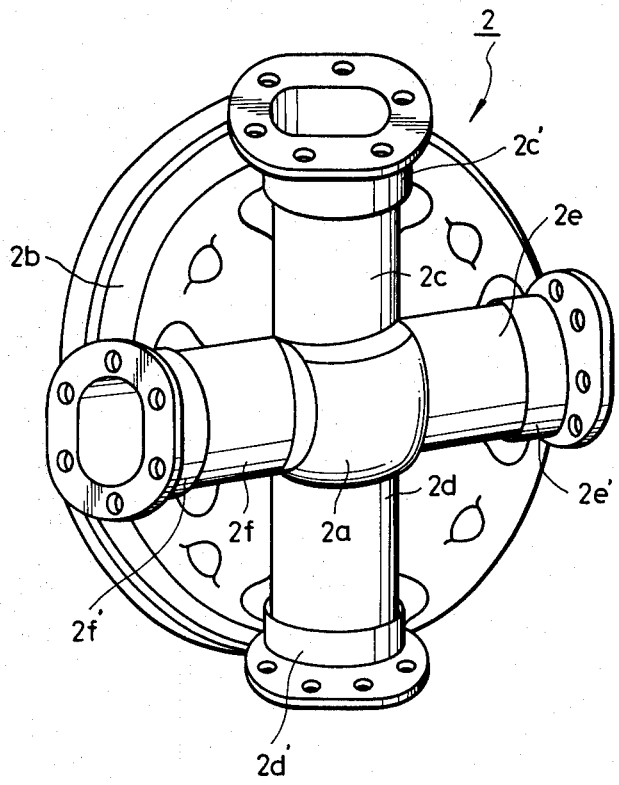
FIG. 3 is a perspective view of the cylinder housing of the compressor.

The cylinder housing 2 is formed of a single structure having a shallow dished base 2*b* and paired cylinder elements 2*c*, 2*d* and 2*e*, 2*f*, each pair forming a cylinder, which are formed integrally with each other and have their axes lying in a common plane, as shown in FIGS. 2 and 3. The cylinder elements 2*c*, 2*d* are arranged in a vertical direction and the cylinder elements 2*e*, 2*f* in a horizontal direction, respectively, to present a cruciform arrangement. A spatial portion 2*a* is defined centrally in the cruciform arrangement by the inner ends of these cylinder elements, in which the aforementioned central space is defined. The dished base 2*b* has its front peripheral end disposed in close contact with the rear peripheral end of the refrigerant containing section 1*b* of the casing 1 and secured thereto by means of bolts 21 at several circumferentially spaced points. The tubular walls of the vertical cylinder elements 2*c*, 2*d* and the horizontal cylinder elements 2*e*, 2*f* and the rear wall of the central spatial portion 2*a* are largely bulged from the rear wall surface of the dished base 2*b* for cooling thereof. These bulged walls are exposed outside the compressor and accordingly permanently cooled, to prevent a drop in the compression efficiency during operation. The central spatial portion 2*a* includes a front opening 2*a*'' which communicates with the low pressure gas suction chamber 1*c* via the bearing retainer member 7 and at the same time receives the rear end portion of the drive shaft 3.

Figure 4:
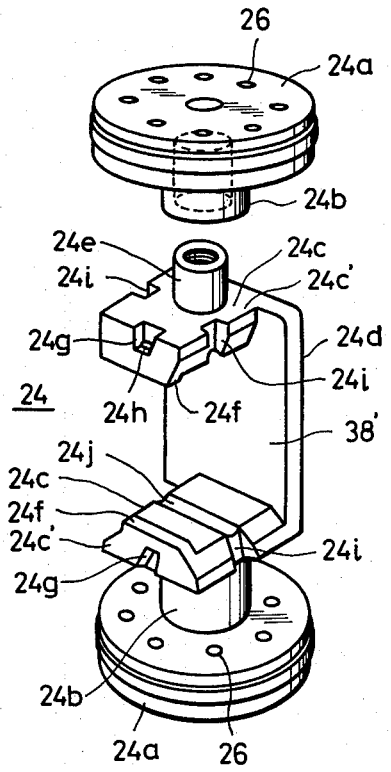
FIG. 4 is a perspective view, partially exploded, of a piston unit used in the compressor.
Figure 5:
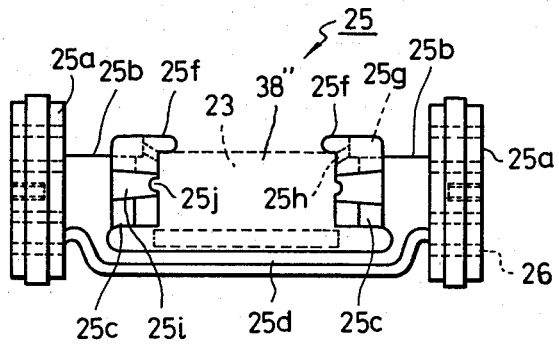
FIG. 5 is a side view of another piston unit used in the compressor.

Piston units 24 and 25 are arranged in the vertical cylinder elements 2*c*, 2*d* and the horizontal cylinder elements 2*e*, 2*f* for reciprocal motion therein along the respective axes thereof. As shown in FIGS. 4 and 5, these piston units 24, 25 each comprise a pair of piston heads 24*a*, 24*a*, 25*a*, 25*a*, each formed therein with a plurality of through bores 26, a pair of stems 24*b*, 24*b*, 25*b*, 25*b*, a pair of slip pieces 24*c*, 24*c*, 25*c*, 25*c*, and coupling members 24*d*, 25*d* coupling together the opposite slip pieces 24*c*, 24*c*, 25*c*, 25*c*, respectively. The piston heads and slip pieces of each piston unit are arranged on the same line in relation opposite to and spaced from each other. More specifically, in one of the piston units, e.g., the piston unit 24 received in the vertical cylinder elements 2*c*, 2*d*, one of the piston heads 24*a* or lower one has its stem 24*b* provided integrally with a generally rectangular slip piece 24*c* larger in width than the stem 24*b*. The other or upper slip piece 24*c* is disposed opposite and spaced by a predetermined distance from the above slip piece 24*c*. These two slip pieces 24*c*, 24*c* have their rear ends integrally joined together by means of a plate-like coupling member 24*d* having a predetermined width.

The first-mentioned slip piece 24*c* has a short shaft 24*e* protruded therefrom and having a tapped axial bore in which the tubular stem 24*b* of the other piston head 24*a* is to be fitted. Thus, this piston head 24*a* can be dismountably mounted on the slip piece 24*c* together with a thin plate valve hereinlater referred to.

The paired slip portions 24*c*, 24*c* cooperate with the coupling member 24*d* to define a fitting recess 38' between their opposite inner walls for receiving a sliding member 23 with a built-in needle bearing 27, as shown in FIG. 2, which has a generally rectangular configuration with its corners cut off. This sliding member 23 receives the eccentric end 3*a* of the drive shaft 3. To assure retaining of the sliding member 23 in a slidable manner, the slip portions 24*c* each have an inwardly extending protuberance 24*f* (FIG. 4) formed at its front end and one lateral edge 24*c*' which is preselected with respect to the axis of the stem 24*b* (i.e., the lateral edge opposed to the rotational direction of the drive shaft 3) is smaller in which than the other one to facilitate lubrication of the sliding member 23.

For the same purpose as above, the paired slip portions 24*c*, 24*c* each have a notch 24*g* formed centrally in its front end and having a small bore 24*h* communicating with its inner side surface, as well as vertical grooves 24*i* formed in its opposite side walls which communicate with a horizontal groove 24*j* formed in the inner side surface of the slip portion 24*c* or in the associated surface of the sliding member 23.

In the other piston unit 25, as shown in FIG. 5, the paired piston heads 25*a*, 25*a* are both formed integrally with their associated stems 25*b*, 25*b* and slip portions 25*c*, 25*c*. The plate-like coupling member 25*d* is bridged between the opposite stems 25*b*, 25*b* and is bulged rearwardly (downwardly in the drawing) so as to define a space for permitting the coupling portion 24*d* of the associated piston unit 24 to be interposed between the sliding member 23 and the piston unit 25 and also permitting the both piston units 24, 25 to execute their reciprocating motions.

Except for the above-mentioned points, the piston unit 25 has an identical construction with that of the piston unit 24. That is, it has one preselected lateral edge 25*c*' thereof configurated smaller in width as viewed from the front, and has a protuberance 25*f* and a notch 25*g* with a small bore 25*h* both provided at its front end as well as vertical grooves or through bores 25*i* formed in its opposite lateral side walls communicating with a transverse horizontal groove 25*j* formed in its inner side surface or in the associated surface of the sliding member 23. Further, a fitting recess 38″ is likewise formed by the opposite inner surfaces of the slip portions 25c, 25c and the inner surface of the coupling portion 25d.

These piston units 24 and 25 are placed in the cylinder housing 2 with their slip portions 24c and 25c directed in different directions by 90 degrees from each other. Fitted in the spatial portion 38 defined between these slip portions 24c and 25c is the aforementioned sliding member 23 which has its built-in needle bearing 27 fitted on the eccentric end 3a of the drive shaft 3 as seen in FIG. 1.

Thin plate valves 28 which are each formed of an elastic material are secured on the outer end surfaces of the piston heads 24a and 25a received in the vertical and horizontal cylinder elements 2c, 2d and 2e, 2f as shown in FIGS. 1 and 2. The outer end flanged portions 2c′, 2d′, 2e′ and 2f′ of the cylinder elements 2c, 2d, 2e and 2f are outwardly expanded and have openings 2c″, 2d″, 2e″ and 2f″ formed in the front side surfaces thereof in communication with the high pressure gas discharge chamber 1d of the front part casing 1. They also have annular offsets 29 formed in the inner walls thereof on which offsets are disposed disk-like valve sheets 30.

These valve sheets 30 are each formed therein with a plurality of axial through bores 31 located in axial alignment with the through bores 26 formed in the piston heads 24a and 25a. Thin plate valves 32 also each formed of an elastic material are disposed over the outer end faces of these valve sheets 30, over which valves are disposed dished valve guards 33 which are curved with their outer peripheries located more axially outwardly than the central portions thereof and which have many notched openings 34 formed along the outer peripheries. The valve sheet, the thin plate valve and the valve guard are integrally secured together by means of a rivet 35 centrally pierced therethrough to form a single valve assembly.

A washer 36 is disposed to cover this single valve assembly, which in turn is covered by a cover 37 secured by screws to the outer end 2c′, 2d′, 2e′ or 2f′ of the flanged portion of each cylinder element with a sealing material 39 intervening between the washer and the cover.

Description will be made about how to assemble the compressor according to the invention which is constructed as above. The thin plate valve 28 is previously mounted on the outer end of each piston head 24a, 25a except the dismountable piston head 24a. Then, the piston unit 25 is inserted into the horizontal cylinder 2e, 2f through one end thereof in the cylinder housing 2 shown in FIG. 3. The sliding member 23 is fitted into the space 38′ between the opposite slip portions 24c of the piston unit 24 with one piston head 24a detached therefrom. This piston unit 24 is inserted into the vertical cylinder 2c, 2d together with the sliding member 23 in a manner that the slip portion 24c with its associated piston head 24a detached therefrom is first inserted into one end of the vertical cylinder. On this occasion, the aforementioned slip portion 24c passes through the space 38″ between the opposite slip portions 25c, 25c of the piston unit 25 into a state where the sliding member 23 has its disengaged opposite side surfaces fitted between the opposite slip portions 25c and 25c, while simultaneously the coupling portion 24d of the piston head unit 24 is positioned in front of the coupling portion 25d of the other piston unit 25.

Then, the detached piston head 24a with the thin plate valve 28 overlaid and secured thereon is inserted into the vertical cylinder 2c, 2d through the same end thereof as aforementioned, followed by fitting its stem 24b onto the short shaft 24e of the aforementioned slip portion 24c, to thus attach the piston head 24a and the thin plate valve 28 to the slip portion 24c.

Thereafter, the aforementioned valve assembly is mounted onto the flanged portion 2c′, 2d′, 2e′ or 2f′ of each cylinder element, and then the cover 37 is attached to the outer end of each cylinder element.

Next, the drive shaft 3 is inserted into the front part casing 1 through the rear end thereof (the right end in FIG. 2) after the retainer member 7 with the bearing 5 retained therein is fitted into the casing 1. The drive shaft 3 is disposed in the casing 1 with its eccentric end 3a projected rearwardly of the rear end of the casing 1. The retaining disc 10 on which the clutch plate 11 is previously mounted is mounted onto the front end of the drive shaft 3. The dished base 2b of the cylinder housing 2 has its front end face brought into contact with the rear end face of the front part casing 1 while the sliding member 23 is fitted onto the eccentric end 3a of the drive shaft 3, followed by fastening the cylinder housing 2 to the casing 1 by means of bolts 21.

In this manner, two pairs of piston units 24, 25 can be simply mounted in the cylinder housing 2 as shown in FIGS. 1 and 2, which housing in turn can be attached to the casing 1 in an abutting manner merely by means of bolts 21 as mentioned above.

As stated above, since the piston units each have a fitting space 38′, 38″ for receiving the sliding member 23 and the piston unit received in the cylinder extending in one direction is a double head type while the other piston unit in the cylinder extending in the other direction is also a double head type but with one head thereof dismountable, it is very easy to mount the piston units into the intersecting cylinders.

The operation of the compressor according to the invention will now be described. In the arrangement of FIG. 1, when the pulley 13 is rotatively driven by an engine, not shown, while simultaneously the electromagnet 14 is energized, the clutch plate 11 is attracted into contact with the magnet 14 to cause rotation of the drive shaft 3 which in turn causes the sliding member 23 engaged with the eccentric rear end 3a of the shaft 3 to rotate eccentrically with respect to the main axis of the drive shaft 3 so that the piston heads 24a and 25a of the piston units 24 and 25 are made to move reciprocally in vertical and horizontal directions in an alternate manner within the vertical and horizontal cylinders 2c, 2d and 2e, 2f by means of the slip portions 24c and 25c embracing the sliding member 23.

The above movements of the piston units 24 and 25 cause the low pressure refrigerant gas in an associated refrigerating circuit to flow into the low pressure gas suction chamber 1c of the front part casing 1 through the inlet port 17 and then travel through the through bore 7b and the small bore 7c in the retainer member 7 and the main bearing 5 in the space 7d into the vertical and horizontal cylinders 2c, 2d and 2e, 2f, as indicated in dotted lines.

After that, when the piston head 24a or 25a moves toward the intersection spatial portion 2a, the refrigerant gas acts upon the thin plate valve 28 to open it and then passes through the through bores 26 into a space between the piston head 24a or 25a and the associated valve sheet 30. As the piston head 24a or 25a moves outwardly, the refrigerant gas in the above space is compressed to open the thin plate valve 32 on the valve sheet 30 when its pressure reaches a predetermined value. The pressurized refrigerant gas is then guided to pass through the through bores 31 and the notched openings 34 into the high pressure gas discharge chamber 1*d* to be delivered into the refrigerating circuit through the discharge pipe 18.

In the above circulation of refrigerant gas, the lubricating oil contained in the refrigerant gas in the form of mist and introduced into the chamber 1*c* is supplied to the front and rear bearings 4 and 5 and the sealing assembly 9 through the bores 7*c* and 7*d* of the bearing retainer member 7 and a gap formed in front of the front face 8*a* of the balance weight 8 and along the channel 6 in the driving section 1*a*, respectively. The lubricating oil mixed in the refrigerant gas staying in the cylinder housing 2 is supplied to the bearing 27 in the sliding member 23 and also to the sliding surfaces of the same member directly or through the smaller-width side portions 24*c*′ and 25*c*′ of the slip portions 24*c* and 25*c* and along the grooves 24*g* and 24*i*, etc. in a manner adhering to the stems 24*b* and 25*b* of the piston units 24 and 25.

It is to be understood that the foregoing description relates to a preferred embodiment of the invention and that various changes and modifications may be made in the invention without departing from the spirit and scope thereof.

What is claimed is:

1. A fluid compressor comprising: a casing having a fluid suction chamber and a fluid discharge chamber formed therein, said casing having an end thereof formed open to define therein an inner peripheral surface; a drive shaft having an end thereof eccentric with respect to the axis thereof, said drive shaft being rotatably supported in said casing in an overhung manner with said eccentric end projected from said open end of said casing; a cylinder housing secured in an abutting manner to said open end of said casing, said cylinder housing having a first cylinder and a second cylinder integrally formed thereon, said first and second cylinders cruciformly intersecting with each other in a common plane, said cylinders defining a first spatial portion opening in the direction of said casing at an intersection thereof; said eccentric end of said drive shaft terminating in said first spatial portion; a first and a second piston arranged in said cylinders in an intersecting manner, said first and second pistons each having a pair of piston heads located at opposite ends thereof, a pair of opposite slip portions located at an intermediate portion thereof, and a coupling portion coupling together said opposite slip portions at ends of said opposite slip portions remote from said casing, said paired slip portions and said coupling portion defining a central recess, said first and second pistons engaging each other for respective reciprocating motions in a manner such that said paired slip portions of one of said pistons are directed in a different direction by 90 degrees from said paired slip portions of the other piston and said coupling portion of one of said pistons is positioned in front of said coupling portion of the other piston, said central recess defined in one of said pistons cooperating with said central recess defined in the other piston to define a second spatial portion opening solely in the direction of said casing; one of said piston heads of at least one of said first and second pistons being dismountable from the body of said at least one piston; a sliding member slidably fitted in said space, said sliding member having an aperture in which is rotatably fitted said eccentric end of said drive shaft, whereby said sliding member is moved eccentrically with respect to the axis of said drive shaft as said drive shaft rotates, to cause said first and second pistons to reciprocatingly move within respective ones of said first and second cylinders in an alternating manner; valve means provided on an outer end of each of said first and second cylinders for regulating the flow of fluid with respect to the interior of said first and second cylinders; a flange-shaped bearing retainer member having a hub formed centrally thereof, said retainer member having a peripheral edge secured to said inner peripheral surface of said open end of said casing, said hub having a central through bore and disposed around a portion of said drive shaft adjacent said eccentric end thereof with said adjacent portion of said drive shaft fitted in said central through bore, said hub being bulged in said first spatial portion of said cylinder housing; and a needle bearing mounted in said central through bore of said hub and supporting as a main bearing said adjacent portion of said drive shaft, said bearing being partially located in said first spatial portion of said cylinder housing.

2. The fluid compressor as claimed in claim 1, wherein said fluid suction chamber includes an open end having an inner peripheral surface and terminating in a plane the same as said open end of said casing, said bearing retainer member having a peripheral edge secured to said inner peripheral surface of said open end of said suction chamber.

3. The fluid compressor as claimed in claim 1 or claim 2, wherein said bearing retainer member includes fluid passage means formed therein which communicates said fluid suction chamber with the interior of said cylinder housing.

4. The fluid compressor as claimed in claim 1 or claim 2, wherein said bearing retainer member includes a bore which communicates said central through bore formed in the hub thereof with said fluid suction chamber for guiding lubricating oil mixed in the fluid in said suction chamber to said main bearing in said central through bore.

5. The fluid compressor as claimed in claim 1, wherein said cylinder housing includes a dished base having a peripheral edge secured to said open end of said casing, said dished base having one end surface thereof formed integrally with said first and second cylinders intersecting with each other in a cruciform arrangement, said first and second cylinders having peripheral lateral surfaces thereof bulged outwardly of the cylinder housing.

6. The fluid compressor as claimed in claim 5, wherein said peripheral edge of said dished base is secured to said open end of said casing in an abutting fashion.

7. The fluid compressor as claimed in claim 1, further comprising a valve mounted on an outer end of each of said piston heads of said pistons, said pistons each having at least one through bore axially formed therein for allowing refrigerant to flow therethrough, whereby the flow of refrigerant is regulated by said valve, said dismountable piston being mountable on associated one of the pistons together with said valve.

8. The fluid compressor as claimed in any of claims 1, 2, 5, 6 or 7 wherein said fluid suction chamber and said fluid discharge chamber are arranged concentrically with each other in said casing, said fluid suction chamber being disposed around said drive shaft and communicating through said bearing retainer member with said spatial portion defined by said cylinders, said fluid discharge chamber being disposed around said fluid suction chamber and communicating with said valve means provided on the outer ends of said cylinders.

* * * * *

UNITED STATES PATENT AND TRADEMARK OFFICE

CERTIFICATE OF CORRECTION

PATENT NO. : 4,352,640

DATED : October 5, 1982

INVENTOR(S) : Hiroshi Takamatsu et al

It is certified that error appears in the above—identified patent and that said Letters Patent is hereby corrected as shown below:

ON THE TITLE PAGE,

The name of the last inventor is incorrect. The correct name is MUTSUO SUGISAKI.

In the Abstract, 10th line, the word "chamber" should read --member--.

Column 4, line 29, the numeral "1" should be --ℓ--.

Signed and Sealed this

Seventh Day of December 1982

[SEAL]

Attest:

GERALD J. MOSSINGHOFF

Attesting Officer

Commissioner of Patents and Trademarks